US007523700B2

(12) United States Patent
Held

(10) Patent No.: US 7,523,700 B2
(45) Date of Patent: Apr. 28, 2009

(54) CYLINDER FOR PROCESSING FLAT MATERIAL

(75) Inventor: Michael Held, Heuchelheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 247 days.

(21) Appl. No.: 11/578,723

(22) PCT Filed: Apr. 13, 2005

(86) PCT No.: PCT/EP2005/051636

§ 371 (c)(1),
(2), (4) Date: Oct. 18, 2006

(87) PCT Pub. No.: WO2005/102891

PCT Pub. Date: Nov. 3, 2005

(65) Prior Publication Data

US 2008/0210106 A1 Sep. 4, 2008

(30) Foreign Application Priority Data

Apr. 26, 2004 (DE) ..... 10 2004 020 303

(51) Int. Cl.
*B65H 45/16* (2006.01)

(52) U.S. Cl. ..... 100/76; 100/155 R; 270/6; 270/38; 270/42; 270/50; 493/424; 493/425; 493/442

(58) Field of Classification Search ..... 100/76, 100/80, 155 R, 158 C, 172; 270/11, 38, 42, 270/50, 60, 6, 13, 20.1, 43; 493/424, 428, 493/432, 445, 425, 434, 442
See application file for complete search history.

(56) References Cited

U.S. PATENT DOCUMENTS

| | | | | |
|---|---|---|---|---|
| 3,521,878 | A * | 7/1970 | Bolza-Schunemann | 493/429 |
| 4,892,036 | A * | 1/1990 | Lange | 101/240 |
| 6,004,242 | A * | 12/1999 | Kostiza | 475/341 |
| 6,250,622 | B1 * | 6/2001 | Fowler et al. | 270/47 |
| 2007/0167306 | A1 * | 7/2007 | Prum | 493/432 |

FOREIGN PATENT DOCUMENTS

| | | |
|---|---|---|
| DE | 196 51 769 | 6/1998 |
| DE | 101 56 194 | 6/2003 |
| EP | 0098415 A2 * | 1/1984 |
| EP | 1 475 336 | 11/2004 |
| GB | 2 066 785 | 7/1981 |

* cited by examiner

*Primary Examiner*—Jimmy T Nguyen
(74) *Attorney, Agent, or Firm*—Jones, Tullar & Cooper, P.C.

(57) ABSTRACT

A cylinder is usable for processing flat material and includes a cylindrical body, which can be rotated about a cylinder axis, and at least one group of a plurality of tools. These tools perform a working movement in relation to the cylindrical body and are coupled to first and second control levers. A fixed cam plate is followed by the first control lever of each tool. A rotating cover disk is followed by the second control lever of each tool. The cover disk comprises a plurality of congruent sectors each having at least one section with a first radius which allows that tool to accomplish its working movement. The cover disk sectors each also have at least one section with a second radius which blocks the working movement of the tool.

15 Claims, 3 Drawing Sheets

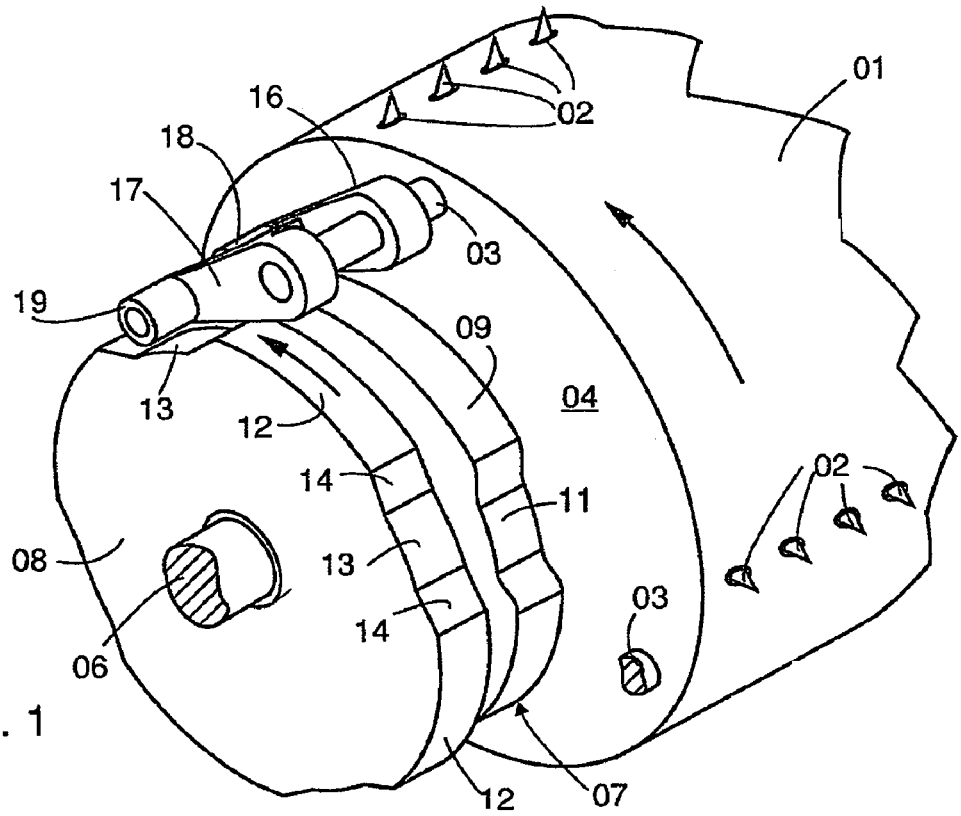
Fig. 1
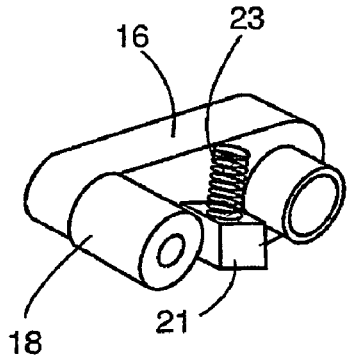
Fig. 2
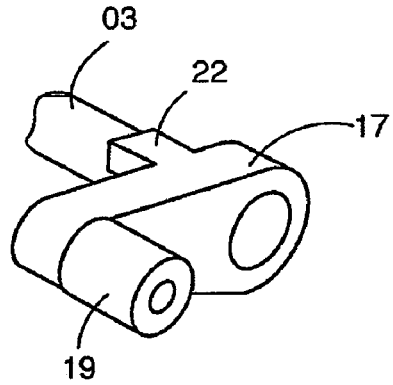
Fig. 3
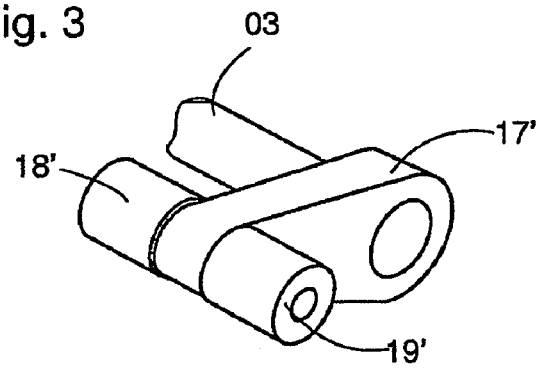

CYLINDER FOR PROCESSING FLAT MATERIAL

CROSS-REFERENCE TO RELATED APPLICATIONS

This U.S. patent application is the U.S. national phase, under 35 USC 371, of PCT/EP2005/051636, filed Apr. 13, 2005; published as WO 2005/102891 A1 on Nov. 3, 2005, and claiming priority to DE 10 2004 020 303.2, filed Apr. 26, 2004, the disclosures of which are expressly incorporated herein by reference.

FIELD OF THE INVENTION

The present invention is directed to cylinders for processing flat material. A cylinder body is rotatable around a cylinder axis and has at least one group of tools evenly distributed over the circumference of the cylinder body. These tools are able to perform an operating movement with respect to the cylinder body.

BACKGROUND OF THE INVENTION

Cylinders of this general type find multiple uses, particularly in the folding apparatus of a printing press, where the movable tools which are distributed over the cylinder circumference surface can be, for example, spur needle strips, grippers, folding blades, folding jaws or the like. These cylinders are accordingly referred to as spur needle cylinders, gripper cylinders, folding cylinders or folding jaw cylinders.

DE 101 56 194 A1 proposes to reduce the frictional wear of a cover disk tracing or follower roller by providing, in place of one control arm with two such tracing, follower or scanner rollers, two control arms, one of which supports the cam disk scanner roller, and the other of which support the cover disk scanner roller. An abrupt acceleration of the cover disk scanner roller is prevented in this prior art device in that it is maintained in steady contact with the cover roller.

SUMMARY OF THE INVENTION

The object of the present invention is directed to providing cylinders for processing flat material, wherein wear between the cover disk of the cylinder and the associated control arrangement for the cylinder is reduced.

In accordance with the present invention, this object is attained by the provision of a cylinder with a cylinder body that is rotatable about a cylinder axis and which has at least one group of tools which are evenly distributed over the circumference of the cylinder body. These tools are able to accomplish a working movement, with respect to the cylinder body. Control levers are provided to effect this working movement and have cam followers that engage the surface of either a stationary cam disk or a rotatable cover disk. The cover disk is rotatable with the cylinder and has a plurality of congruent sectors. Each such sector has sections of different radii. When the followers engage these sections, they either allow movement of the control lever or prevent such movement.

The advantages which can be obtained by the present invention lie, in particular, in that wear in the contact area between the cover disk and the control arrangement scanning it is kept low. This is accomplished without requiring a constant contact between the control arrangement and the cover disk.

Instead of attempting to avoid wear on the control arrangement, by keeping its scanning roller, which scans the cover roller, continuously in rotation, in accordance with the teachings of the prior art DE 101 56 194 A1, in the construction, in accordance with the present invention, a loss of contact between the control arrangement and the cover roller is permitted and is accepted. Wear is reduced by reducing the relative speed between the rotating cylinder body and the cover disk. By increasing the number of congruent sectors of the cover disk, over that which is typical in prior art structures, the difference in rotating speed between the cylinder body and the cover disk, which is required for the control of the tool movement with the desired periodicity, is clearly reduced. In a cylinder with, for example five tools, and customarily with at most three sectors, a ratio between the control speed of the cylinder and that of the cover disk of 6:5 was customarily required in connection with dual collating operations. A ratio of 12:11 results in response to doubling the number of sectors thereby, in effect, halving of the rotating speed difference. The acceleration which is encountered by a scanning roller of the control arrangement which is scanning the cover disk is therefore halved. Since wear increases more than proportionally, with respect to the occurring acceleration, the service life of the scanning or cam following roller is even more than doubled.

The roller for scanning or following or tracing the cover disk can be simply mounted on a common control lever, together with a roller for scanning or following or tracing the cam disk. However, in such a configuration, the roller of the cam disk always loses contact with the cam disk at the time the cover disk blocks the operating movement of the control lever. The cam disk roller is thus slowed down and must then be accelerated again. To avoid this, it is also possible to provide two control levers, one for each roller, the provision of which two control levers permits the roller of the cam disk to remain in contact with the cam disk even when the cover disk blocks the operating movement of the control lever.

BRIEF DESCRIPTION OF THE DRAWINGS

A preferred embodiment of the present invention is represented in the drawings and will be described in greater detail in what follows.

Shown are in:

FIG. 1, a perspective view of a portion of a spur needle cylinder in accordance with the present invention, in FIG. 2, an exploded perspective detailed view of the control arrangement of the present invention, with two control levers of a spur needle strip of the spur needle cylinder of FIG. 1, in FIG. 3, a detailed perspective view of a simplified control arrangement having one control lever and two rollers mounted thereon, in FIG. 4, a side elevation view schematically depicting relative positions of the cam and cover disks in connection with dual collation operations of a cylinder, in FIG. 5, a side elevation view schematically depicting relative positions of the cam and cover disks in connection with triple collation operations of a cylinder, in FIG. 6, a side elevation view schematically depicted relative positions of the cam and cover disks with quadruple collation operations, and in FIG. 7, a depiction of a gear for coupling the rotations of the cylinder body and the cover disk.

DESCRIPTION OF THE PREFERRED EMBODIMENTS

Figure 4:
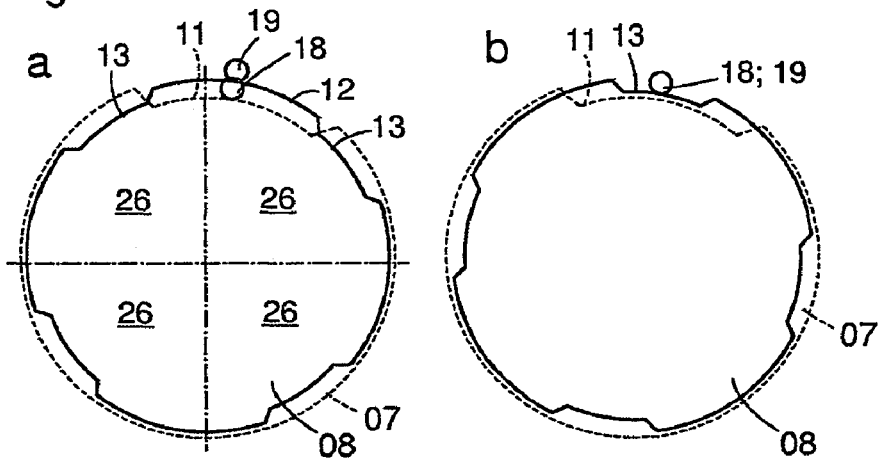

FIG. 1 shows an end section of a cylinder body 01 with three spur needle strips, only two of which are visible in FIG. 1. For the sake of simplicity, the cylinder body 01 has been represented here in a narrow, geometric sense. However, it is to be understood that it is possible, in actuality, to depart from the geometric closed cylinder shape of the cylinder, provided that signatures positioned on the shell face of the cylinder 01 are conveyed on a path which is shaped as a circle or as a sector of a circle. It is possible, in particular, for the shell surface of the cylinder body 01 to be constructed of a plurality of segments, which segments can be shifted with respect to each other. The tools 02, such as, for example, the depicted spur needles 02 of the spur needle strips, can be extended out of rows of holes which are respectively arranged spaced at a circumferential distance of 120° on the shell surface of the cylinder body 01. The spur needles 02 are extended radially out from the cylinder shell surface, through the depicted holes in order to spear signatures conveyed on the cylinder shell surface and to further transport them, on the cylinder body 01, to a transfer gap, which is not specifically represented. During the transfer or the handing over of the signatures at the transfer gap, the spur needles 02 must be retracted into the interior of the cylinder 01. To accomplish this purpose, the spur needles 02 in each row or group are respectively fixedly connected with a cooperating shaft 03 by the use of suitable arms, which are hidden by the shell of the cylinder body 01 in FIG. 1. Each of these arms is pivotably seated in two oppositely located front or end plates 04 of the cylinder body 01. Journals 06 of the cylinder body 01, which are connected with the front or end plates 04 of the cylinder body 01, are rotatably seated in a lateral frame, which is not specifically represented. A stationary cam disk 07 and a rotatable cover disk 08 are provided and are arranged coaxially with respect to the journal 06, as represented in FIG. 1. The stationary cam disk 07 substantially has the shape of a circular disk which is arranged concentrically with respect to the axis of rotation of the cylinder body 01. A circumferential section 11, such as, for example, an indentation 11, has been formed on a circumferential face 09 of the stationary cam disk 07. The rotatable cover disk 08 can be seen in FIG. 1 as being constructed having four congruent 90° sectors, each of which sectors has a section 12 in the form of an arc of a circle with a large radius, a section 13 with a lesser radius, as well as inclined faces 14, which inclined faces 14 constitute gradual transitions between the sections 12, 13.

Each one of the three shafts 03 of the cylinder body 01 supports two control levers 16, 17. Each of these two control levers 16, 17 respectively forms a control arrangement for use in controlling the movement of one of the spur needle strips. For the sake of clarity, the control levers 16, 17 are represented, in FIG. 1, on only one of the three shafts 03. The first, interior, cam disk control lever 16 has a first or a cam disk follower roller 18, which rolls off on the circumferential surface of the cam disk 07. In an analogous manner, the second, exterior, cover disk control lever 17 has a second or a cover disk follower roller 19, which rolls off on the circumferential surface of the cover disk 08. The second control lever 17 is fixedly connected with the shaft 03, while the first control lever 16 can be rotated around the shaft 03.

The control levers 16, 17 each have a protrusion 21 or 22, respectively on their assigned lateral flank each of which lateral flanks is facing the associated lateral flank of other control lever 16, 17. A pressure spring 23, which exerts a spring force that drives the two protrusions 21, 22 apart, as may be seen in FIG. 2, lies between the two protrusions 21, 22. The torque of a second spring, which is not specifically represented, and which is housed, for example, in the cylinder body 01, acts, via the shaft 03, on the second control lever 17 and drives the roller 19 of the second control lever 17 against the circumferential surface of the cover disk 08. In spite of this, in the position represented in FIG. 1, the roller 19 does not touch the cover disk 08. The mutual engagement of the protrusions 21, 22 with each other, and the contact of roller 18 of the first control lever 16, which simultaneously rolls off on the circumferential face 09 of cam disk 07, prevent this. In the course of the entire revolution of the cylinder body 01, the roller 18 is in continuous contact with the stationary cam disk 07 and because of this continuous contact, is being uniformly rotatorily driven. However, when the roller 18 enters the indentation 11 on the face 09 of the stationary cam disk 07, this results in a movement of the spur needles 02 only if, at the same time, the cover disk roller 19 is located opposite a section 13 of the cover disk 08 which is formed with a small radius. If, as represented in FIG. 1, this is not the case, the roller 19 loses contact with the cover disk 08 and is slowed in its rotation until it again comes into contact with a large radius section 12 of the cover disk 08.

In a perspective view, which is analogous to FIG. 2, FIG. 3 shows a simplified control arrangement. A single control lever 17', which is fastened on the shaft 03, supports two rollers 18', 19' for rolling off on the cam disk 07 or the cover disk 08, respectively. The control lever 17' pivots radially inward only in the situation where both rollers 18', 19' simultaneously pass an indentation 11 on the cam disk 11 and a section 13 of a small radius on the cover disk 08.

In place of three folding blades 02, or spur needle strips with spur needles, or grippers or folding jaws, the cylinder 01 can also have five or seven sections, and thus can have five or seven rows or groups of tools 02, and in particular can have five or seven rows or groups of folding blades 02, or spur needle strips with spur needles, grippers or folding jaws.

FIG. 4 shows two schematic side elevation views of the stationary cam disk, which is represented in dashed lines, and of the rotatable cover disk 08, both of which are formed by four identical sectors 26, and of the rollers 18, 19, while the rollers pass the indentation 11 of the stationary cam disk 07. In part "a" of FIG. 4 a section 12 of large radius of the rotatable cover disk 08 supports the cover disk roller 19. The retraction of the spur needles 02 into the cylinder body 01 and a release of the signature held on the spur needles 02 is thereby prevented, even though the cam disk roller 18 dips into the indentation. A ratio of the number of revolutions of the cylinder body 01 and of the rotatable cover disk 08 is 8:7. When the cylinder body 01 has made a complete revolution and the roller 18 again reaches the indentation 11, the cover disk 08 has only turned by ⅞ of a revolution which, as shown in part "b" of FIG. 4, results in a rotary displacement of 45° of the rotatable cover disk 08 with respect to the stationary cam disk 07 in comparison to the case shown in part "a" of FIG. 4. Thus, in part "b" of FIG. 4, the indentation 11 and a section 13 of a small radius of the cover disk 08 coincide. The cover disk roller 19 thus moves radially inwardly and the spur needles 02 are retracted.

In connection with a control arrangement such as the one shown in FIG. 3, in the case of part "a" in FIG. 4, the contact between the roller 19' and section 12 would prevent the roller 18' from dipping into the depression and the retraction of the spur needles 02 would also be blocked. In the case of part "b" of FIG. 4, both rollers 18', 19' dip in their respective depressions and the spur needles 02 would be retracted. Thus, the movement of the spur needles 02 is the same in connection with the embodiment shown in FIG. 3 as it is with the two-armed control arrangement represented in FIG. 2.

Figure 5:
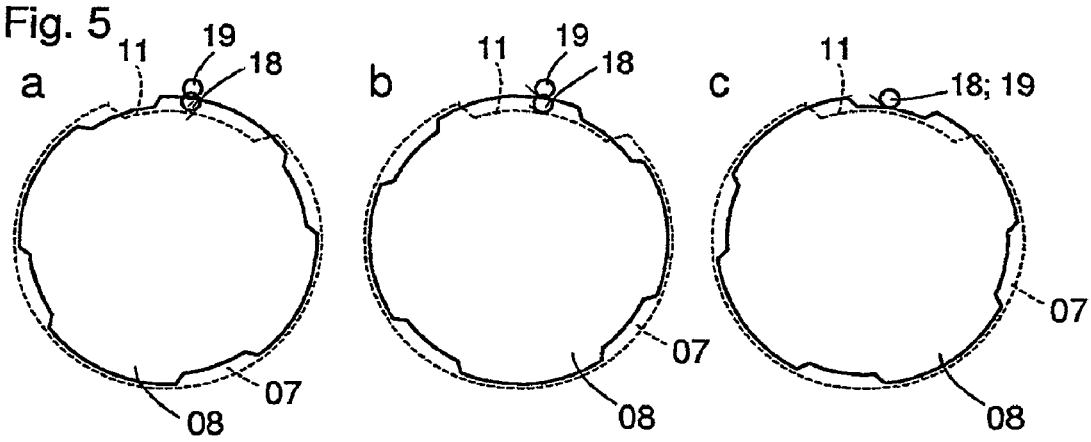

In the case of the depiction of FIG. 5, the ratio of the numbers of revolutions of the cylinder body 01 and the cover disk 08 is 12:11. Thus, as shown in part "c" of FIG. 5, the indentation 11 in the cam disk 07 and the indentation 13 in the cover disk 08 only meet at every third revolution of the cylinder body 01. Therefore, three signatures are collated prior to every retraction of the spur needles 02. The difference in the rotating speeds of the cylinder body 01 and the cover disk 08 is even less here than was the case of FIG. 4, and the wear on the roller 18 is correspondingly less.

Figure 6:
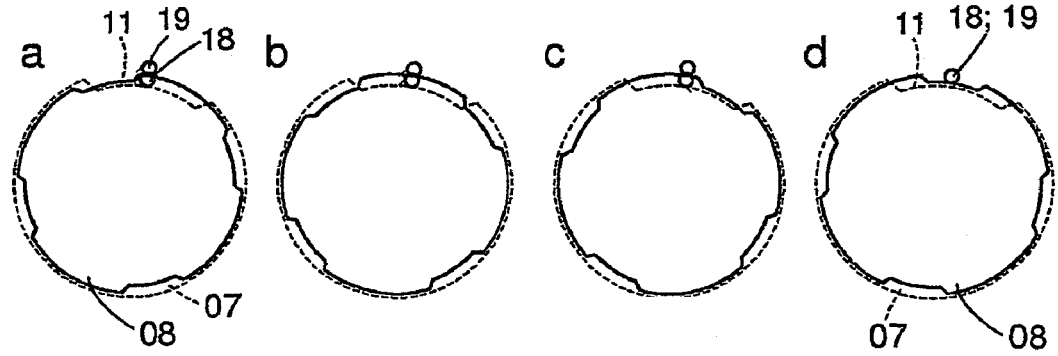

As depicted in FIG. 6, it is possible to increase the number "p" of revolutions of the cylinder 01, before release of the collated products, even more. However, with the angular extension of the indentation 11, which is represented here by way of example, it is questionable whether, in the cases "a" and "c" of FIG. 6, the sections 12 over the entire extent of the indentation 11 could prevent the penetration of the roller 18. The smaller the angular extension of the indentation 11, the greater the number of possible collation processes obviously becomes. In order to make "p"-times collations possible, the angular extension of the indentation 11 must not be greater than $2\pi/p$.

Figure 7:
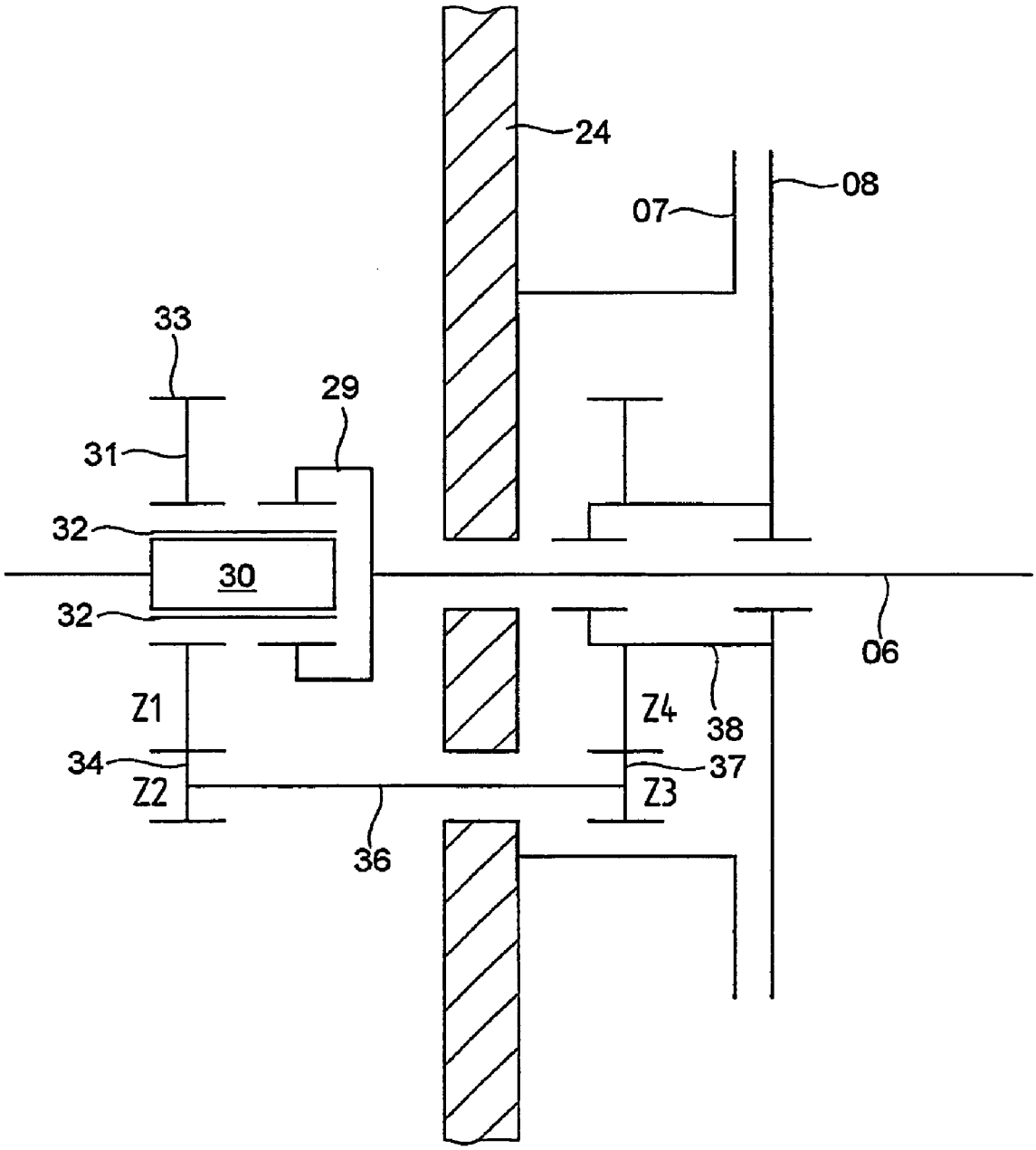

FIG. 7 shows a preferred embodiment of a coupling gear between the cylinder body 01, of which only the journal 06 is schematically represented in FIG. 7, and the cover disk 08. The journal 06 crosses, and is rotatably seated, in a lateral frame plate 24 and has, at its end which is facing away from the cylinder body 01, a first hollow gear wheel 29 of a harmonic drive gear. This first hollow gear wheel 29, and a second hollow wheel 31 mesh with a flex spline 32. An exterior ring gear 33, which is fixedly connected with the second hollow gear wheel 31, meshes with a pinion gear 34, which is part of a shaft 36, and which shaft 36 is offset with respect to the shaft of the cylinder body 01, which shaft 36 crosses the lateral frame plate 24 and which shaft 36 has a further pinion gear 37 on the inside of the shaft 36. Pinion gear 37 drives a sleeve 38 which is rotatably pushed onto the journal 06 and which sleeve supports the cover disk 08. Assuming that the wave generator 30, which is situated in the interior of the flex spline 32, does not rotate, and with an amount of teeth for the hollow wheel 29 being 160, with 162 teeth for the hollow wheel 31, 81 teeth for the exterior ring gear 33, 24 teeth for the pinion gear 34, 22 teeth for the pinion gear 37 and 80 teeth for exterior of the sleeve 38, a ratio of the number of revolutions of 12:11 results between the cylinder body 01 and the cover disk 08. Because of this ratio, as assumed in connection with FIGS. 1 to 5, a dual collation operation; i.e. a collation and cooperative delivery of three products, can be realized. With a cover disk with six segments, a single collation operation; i.e. a collation and delivery of two products.

The relative position of the cover disk 08, in relation to the several control levers 17 of the cylinder body 01, can be adjusted by rotation of the wave generator 30 in order to assure that in the course of the passage of one of the control levers 18 in front of the indentation 11 of the cam disk 07, the roller 19 of the control lever 17 associated with the cover disk 08 does not change from a section 12 to a section 13, or vice versa. The wave generator 30 is maintained, fixed against relative rotation, during the collation operation. To be able to operate the cylinder 01 in a non-collation mode, it is possible to provide a coupling between the cylinder journal 06 and the sleeve 38 which coupling, when it is closed, lets the cover disk 08 rotate at the speed of the cylinder body 01. When this coupling is closed, the wave generator 30 is permitted to rotate.

By the rotatory driving of the wave generator 30 at a suitable speed, it is also possible to realize different collation numbers, corresponding to the respective gear ratio between the cylinder body 01 and the cover disk 08. For the same purpose it would also be possible to replace the gear in FIG. 7 with a suitable control gear, wherein several switching stages are replaced in accordance with different values of p=(2, 3, . . . ∞). In general, the ratio of the numbers of revolutions of the cylinder body 01 and of the cover disk 08 should always amount to $1:1\pm1/(p\times m)$, wherein "m" is the number of the sectors 26 of the cover disk 08, and "p" is a low natural number ≧2 or ∞. In this case, "p"=∞ corresponds to the above mentioned case of non-collating operation with a rotating cover disk 08 rigidly coupled to the cylinder body 01; "p"=1 corresponds to the case of non-collating operation with a stationary cover disk 08, and all other values of "p" correspond to a respective ("p"−1)—times collation operation.

The number "m" of the sectors 26 is at least equal to $$\frac{n}{2+1},$$

i.e.

$$m \geq \frac{n}{2+1},$$

or m is at least 4, i.e. m=≧4 and wherein "n" is the number of groups of tools distributed evenly over the cylinder body circumference.

In connection with the above preferred embodiments, only spur needle strips 02 have been used as examples of tools 02 which are attached to the cylinder body 01 and which are periodically driven. However, it is to be understood that the invention can also be applied, in the same way as described above, to other periodically moved tools 02, such as folding blades 02, spur needle strips with spur needles, grippers, folding jaws, and the like, which are driven at a period that is a multiple of the period of rotation of the cylinder body 01.

For example, the cylinder body 01, as well as the cover disk 08, rotate in a counterclockwise direction, as shown in FIG. 2. The control arrangement 16, 17, 17' is embodied to be leading or extending in the direction of rotation, for example.

While preferred embodiments of a cylinder for processing flat material, in accordance with the present invention, have been set forth fully and completely hereinabove, it will be apparent to one of skill in the art that various changes in, for example, the specific printing press producing the material to be processed, the drive for the cylinder, and the like could be made without departing from the true spirit and scope of the present invention which is accordingly to be limited only by the appended claims.

What is claimed is:

1. A cylinder usable to process sheet material comprising:

a cylinder body having a cylinder body circumference and a cylinder axis and being rotatable about said cylinder axis;

a number "n" of groups of tools distributed evenly over said cylinder body circumference and being adapted to perform an operating movement with respect to said cylinder body;

a control arrangement for each of said groups of tools and usable to drive said operating movement of said group of tools;

a stationary cam disk traced by each said control arrangement;

a rotatable cover disk, said rotatable cover disk being coupled to the rotation of said cylinder body and being traced by each said control arrangement;

a number "m" of congruent sectors on said cover disk and each of said sectors having at least one section of a first radius, each said first radius section, when it is traced by said control arrangement, allowing said operating movement of said one of said groups of tools associated with said control arrangement, each said sector also having at least one section of a second radius which is different from said first radius, each said second radius section, when it is traced by said control assembly, blocking said operating movement of said one of said groups of tools associated with said control arrangement, said number "m" of said sectors being at least equal to "n"/(2+1), a ratio of a number of rotations of said cylinder and of said cover disk being 1:1±1/"p"×"m" wherein "p" is a whole number ≧2.

2. The cylinder of claim 1 wherein said number "m" of said congruent sectors on said cover disk is at least 4.

3. The cylinder of claim 1 further including a switch gear coupling said rotatable cover disk and said cylinder body and having a plurality of switching stages corresponding to values of said whole number "p".

4. The cylinder of claim 1 further including a harmonic drive coupling said rotatable cover disk and said cylinder body.

5. The cylinder of claim 1 when said second radius is greater than said first radius.

6. The cylinder of claim 1 wherein said stationary cam disk has a first circumferential section in the shape of a segment of a circle and which is coaxial with said cylinder body axis, and further wherein said stationary cam disk has a second circumferential section which differs from the shape of a circle, an angular extension of said second section being not greater than 2 π/"p".

7. The cylinder of claim 1 wherein said control arrangement for each said group of tools includes a control lever with a cam disk tracing roller and with a cover disk tracing roller.

8. The cylinder of claim 1 wherein said control arrangement for each said group of tools includes first and second control levers pivotable about a common shaft, said first control lever tracing said cam disk and said second lever tracing said cover disk.

9. The cylinder of claim 1 wherein said number "n" of groups of tools is selected from grippers, spur needle strips, folding blades and folding jaws.

10. The cylinder of claim 1 wherein there are five of said groups of tools.

11. The cylinder of claim 10 wherein said tools are spur needle systems.

12. The cylinder of claim 1 wherein there are seven of said groups of tools.

13. The cylinder of claim 12 wherein said tools are spur needle systems.

14. The cylinder of claim 1 wherein there are three of said groups of tools.

15. The cylinder of claim 14 wherein said tools are spur needle systems.

* * * * *